US009091255B2

(12) United States Patent
Yoshimura

(10) Patent No.: US 9,091,255 B2
(45) Date of Patent: Jul. 28, 2015

(54) FUEL SUPPLY PUMP

(75) Inventor: Tetsuya Yoshimura, Toyota (JP)

(73) Assignee: DENSO CORPORATION, Kariya (JP)

( * ) Notice: Subject to any disclaimer, the term of this patent is extended or adjusted under 35 U.S.C. 154(b) by 690 days.

(21) Appl. No.: 13/314,722

(22) Filed: Dec. 8, 2011

(65) Prior Publication Data

US 2012/0145131 A1 Jun. 14, 2012

(30) Foreign Application Priority Data

Dec. 10, 2010 (JP) ..... 2010-275518

(51) Int. Cl.
*F02M 37/06* (2006.01)
*F04B 1/04* (2006.01)

(52) U.S. Cl.
CPC ..... *F04B 1/0408* (2013.01); *F02M 37/06* (2013.01); *F04B 1/0421* (2013.01); *F04B 1/0448* (2013.01)

(58) Field of Classification Search
CPC ... F02M 59/442; F02M 59/102; F02M 21/08; F02M 57/023; F02M 37/043; F02M 37/06; F02M 59/04; F02M 59/464; F02D 33/003; F02D 41/3827; F02B 3/06
USPC ..... 251/129.15, 29.01, 337, 336; 60/375, 60/381, 382, 412, 434, 446, 449, 450, 462, 60/476, 479, 488, 489; 73/114.41, 114.42, 73/114.43, 862.543, 861.59, 863.83, 73/864.34; 184/6.18, 6.21, 6.28, 7.2, 7.3, 184/7.4, 26, 32, 37, 52, 100, 104.1; 123/495, 206, 41.6, 41.47, 62, 68, 70 R, 123/72, 65 B, 338, 339.39, 357, 359, 364, 123/379, 446, 497, 498, 499, 500, 508, 510, 123/179.17, 198 C, 196 R, 434, 496, 501, 123/502, 503, 504, 506, 507, 514, 41.46
See application file for complete search history.

(56) References Cited

U.S. PATENT DOCUMENTS 4,915,592 A * 4/1990 Hishinuma et al. ..... 417/206
5,058,553 A * 10/1991 Kondo et al. ..... 123/456
5,094,216 A * 3/1992 Miyaki et al. ..... 123/506
5,197,438 A * 3/1993 Kumano et al. ..... 123/506
5,201,294 A * 4/1993 Osuka ..... 123/458

(Continued)

FOREIGN PATENT DOCUMENTS

JP 2010106741 A * 5/2010
JP P2010-106741 A 5/2010

(Continued)

OTHER PUBLICATIONS

Hashida et al.,JP 2010106741 A, May 2010, Machine Translation.*

(Continued)

*Primary Examiner* — Lindsay Low
*Assistant Examiner* — John Bailey
(74) *Attorney, Agent, or Firm* — Nixon & Vanderhye P.C.

(57) ABSTRACT

A leak recovery groove is formed in a slide clearance between a slidable surface of a cylinder body and a slidable surface of a plunger to recover leaked fuel, which is leaked from a pressurizing chamber. A leak recovery groove direct communication passage is branched from a supply passage, which supplies fuel to the pressurizing chamber, and is connected to the leak recovery groove without passing through the pressurizing chamber to supply the fuel from the supply passage to the leak recovery groove.

5 Claims, 4 Drawing Sheets

(56) References Cited

U.S. PATENT DOCUMENTS

| | | | | |
|---|---|---|---|---|
| 5,277,156 | A * | 1/1994 | Osuka et al. | 123/198 DB |
| 5,603,303 | A * | 2/1997 | Okajima et al. | 123/508 |
| 5,957,674 | A * | 9/1999 | Zenmei et al. | 417/505 |
| 6,112,727 | A * | 9/2000 | Cristiani et al. | 123/514 |
| 6,598,579 | B2 * | 7/2003 | Goodenough et al. | 123/198 D |
| 6,626,148 | B1 * | 9/2003 | Cooke et al. | 123/447 |
| 6,776,143 | B2 * | 8/2004 | Goodenough et al. | 123/495 |
| 6,805,105 | B2 * | 10/2004 | Kato et al. | 123/514 |
| 7,017,554 | B2 * | 3/2006 | Wang | 123/446 |
| 7,428,894 | B2 * | 9/2008 | Kikutani et al. | 123/506 |
| 7,497,666 | B2 * | 3/2009 | Garris, Jr. | 417/182 |
| 8,061,328 | B2 * | 11/2011 | Shafer et al. | 123/446 |
| 2002/0189589 | A1 * | 12/2002 | Kato et al. | 123/458 |
| 2003/0089344 | A1 * | 5/2003 | Rodriguez et al. | 123/520 |
| 2006/0185648 | A1 * | 8/2006 | Felton | 123/446 |
| 2010/0024779 | A1 * | 2/2010 | Makita | 123/495 |
| 2010/0101538 | A1 * | 4/2010 | Beardmore | 123/495 |
| 2010/0226795 | A1 * | 9/2010 | Shaull et al. | 417/290 |
| 2011/0052427 | A1 * | 3/2011 | Shaull et al. | 417/364 |
| 2012/0145131 | A1 * | 6/2012 | Yoshimura | 123/495 |
| 2012/0255433 | A1 * | 10/2012 | Hopley et al. | 91/418 |
| 2013/0206112 | A1 * | 8/2013 | Tamai et al. | 123/508 |

FOREIGN PATENT DOCUMENTS

| | | |
|---|---|---|
| JP | 2010-144673 | 7/2010 |
| JP | 2010144673 A * | 7/2010 |

OTHER PUBLICATIONS

Kon, Koichi, JP 2010144673 A, Jul. 2010, Machine Translation.*
JP 2010106741 A, Machine translation, Hashida et. al.*
JP 2010144673 A, Machine translation, Kon, Koichi.*
Japanese Office Action dated Sep. 11, 2012, issued in corresponding Japanese Application No. 2010-275518 with English translation.

* cited by examiner

FUEL SUPPLY PUMP

CROSS REFERENCE TO RELATED APPLICATION

This application is based on and incorporates herein by reference Japanese Patent Application No. 2010-275518 filed on Dec. 10, 2010.

BACKGROUND OF THE INVENTION

1. Field of the Invention

The present invention relates to a fuel supply pump.

2. Description of Related Art

With reference to FIG. 4, one prior art fuel supply pump 100 includes a plunger 101, a cylinder body 103 and a plunger drive mechanism 105 (see, for example Japanese Unexamined Patent publication JP2010-144673A). The plunger 101 is adapted to axially reciprocate. The cylinder body 103 has a cylinder hole 102, in which the plunger 101 is received such that the plunger 101 is adapted to axially reciprocate in the cylinder hole 102. The plunger drive mechanism 105 converts rotational motion, which is transmitted from an internal combustion engine (not shown), into linear reciprocating motion and conducts it to the plunger 101. The fuel supply pump 100 is applied to an accumulator type fuel injection system, which injects the high pressure fuel of over, for example, 100 MPa received from a common rail 106 into the internal combustion engine.

In the prior art fuel supply pump 100, one axial end portion of the cylinder hole 102 is partitioned by the plunger 101 to form a pressurizing chamber 108. When the plunger 101 is axially reciprocated in the cylinder hole 102, a volume of the pressurizing chamber 108 is changed to draw fuel into the pressurizing chamber 108 and to discharge the fuel from the pressurizing chamber 108 upon pressurizing the same in the pressurizing chamber 108. Hereinafter, the plunger 101 and the cylinder body 103 may be collectively referred to as a high pressure pump 109.

In the prior art fuel supply pump 100, the fuel of the pressurizing chamber 108 leaks from the pressurizing chamber 108 to the other axial end side through a slide clearance 110 between the plunger 101 and the cylinder body 103. Therefore, a leak recovery groove 111 is formed between a slidable surface of the cylinder body 103 and a slidable surface of the plunger 101 by radially outwardly recessing a portion of the slidable surface of the cylinder body 103. The fuel of the leak recovery groove 111 is returned to a fuel tank 113 through a check valve 112.

Lately, the fuel injection pressure of the fuel injection system is increased to the high pressure, and there is a continuous demand to further increase the discharge pressure of the fuel supply pump 100. However, when the discharge pressure is further increased, the temperature of the fuel, which is compressed and pressurized in the pressurizing chamber 108, becomes higher. Therefore, the temperature of the high pressure pump 109 becomes high, and the following disadvantages may be encountered.

First of all, the fuel, which is drawn into the pressurizing chamber 108, is immediately heated by the heated high pressure pump 109, so that the temperature of the fuel becomes high, and thereby a viscosity of the fuel is reduced. Thus, the amount of fuel leakage from the pressurizing chamber 108 is increased to possibly cause a decrease in the discharge quantity of the fuel supply pump 100 (reduction of the discharge efficiency).

Furthermore, the amount of fuel leakage from the leak recovery groove 111 toward the other axial side may possibly be increased due to the decrease in the viscosity of the fuel of the pressurizing chamber 108. Therefore, in the case where the plunger drive mechanism 105 is lubricated by the lubricating oil, which has the viscosity higher than that of the fuel, the lubricating oil may possibly be diluted by the fuel to cause lubrication failure.

Furthermore, various seal elements, such as O-rings, are installed in the high pressure pump 109. The high temperature of the high pressure pump 109 may possibly cause deterioration of the lifetime of the seal elements.

Furthermore, the leaked fuel tends to be degraded by the high temperature, so that deposits may be accumulated in a return flow passage, which extends from the leak recovery groove 111 to the fuel tank 113, thereby possibly causing clogging of the flow passage with the accumulated deposits.

Therefore, it has been demanded to provide a structure of the fuel supply pump 100, which can limit the temperature increase of the high pressure pump 109 even upon increasing of the discharge pressure.

SUMMARY OF THE INVENTION

The present invention addresses the above disadvantages.

According to the present invention, there is provided a fuel supply pump, which includes a plunger and a cylinder body. The plunger is adapted to reciprocate in an axial direction thereof. The cylinder body includes a cylinder hole, in which the plunger is axially slidably received. One axial end portion of the cylinder hole is fluid-tightly closed by the plunger to form a pressurizing chamber. The plunger is adapted to reciprocate and slide in the axial direction in the cylinder hole to change a volume of the pressurizing chamber and thereby to draw fuel into the pressurizing chamber and then discharge the fuel from the pressurizing chamber upon pressurization of the fuel in the pressurizing chamber. A slide clearance is formed between the plunger and the cylinder body and enables leakage of fuel from the pressurizing chamber, which is located on one axial side of the slide clearance, toward the other axial side of the slide clearance through the slide clearance. A leak recovery groove is formed in the slide clearance between a slidable surface of the cylinder body and a slidable surface of the plunger by radially outwardly recessing a portion of the slidable surface of the cylinder body to recover leaked fuel, which is leaked from the pressurizing chamber. A leak recovery groove direct communication passage is branched from a supply passage, which supplies fuel to the pressurizing chamber, and is connected to the leak recovery groove without passing through the pressurizing chamber to supply the fuel from the supply passage to the leak recovery groove.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Figure 1:
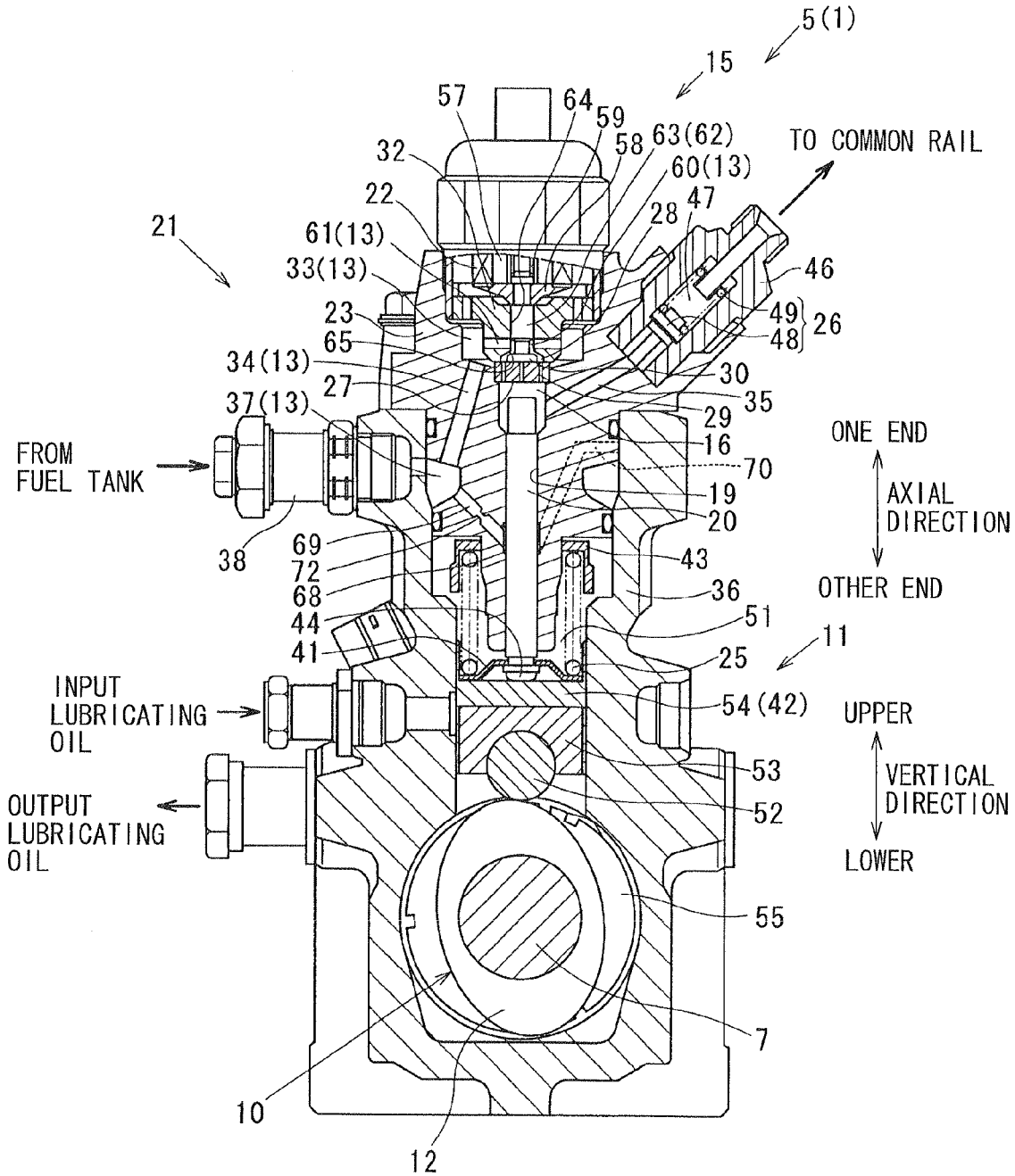
FIG. 1 is a schematic cross-sectional view showing a structure of a high pressure pump system of a fuel supply pump according to an embodiment of the present invention.
Figure 2:
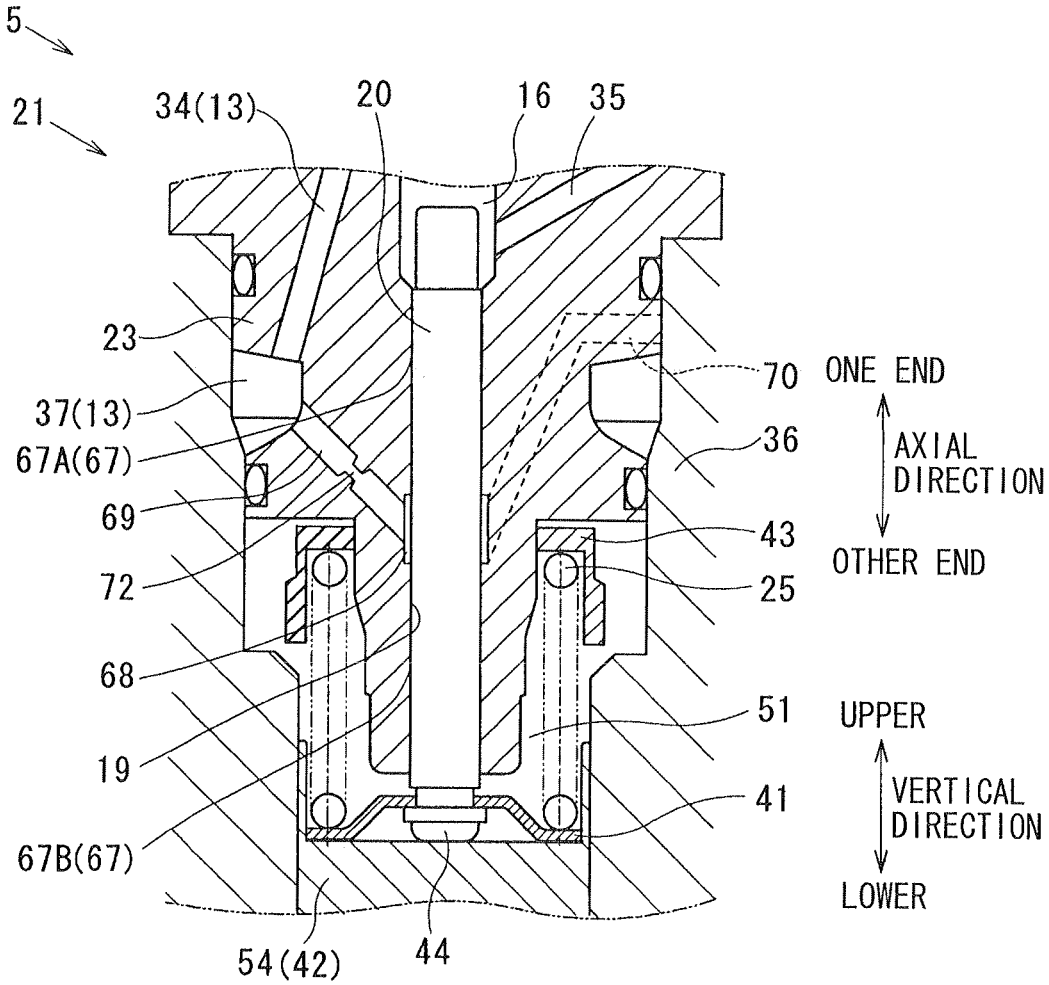
FIG. 2 is a partial enlarged schematic cross sectional view showing a feature of the high pressure pump system of the embodiment.
Figure 3:
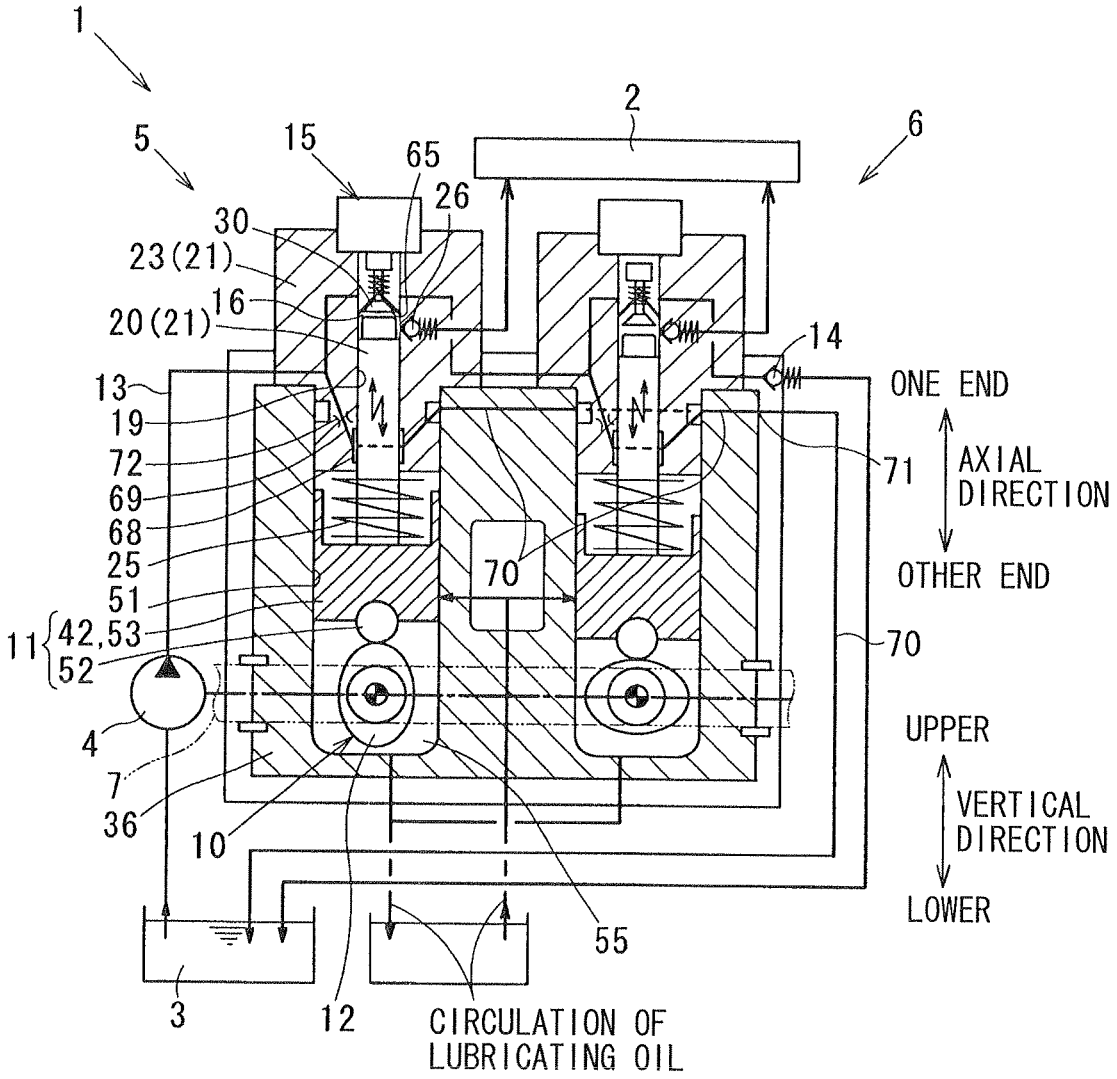
FIG. 3 is a schematic cross sectional view showing an entire structure of the fuel supply pump of the present embodiment.
Figure 4:
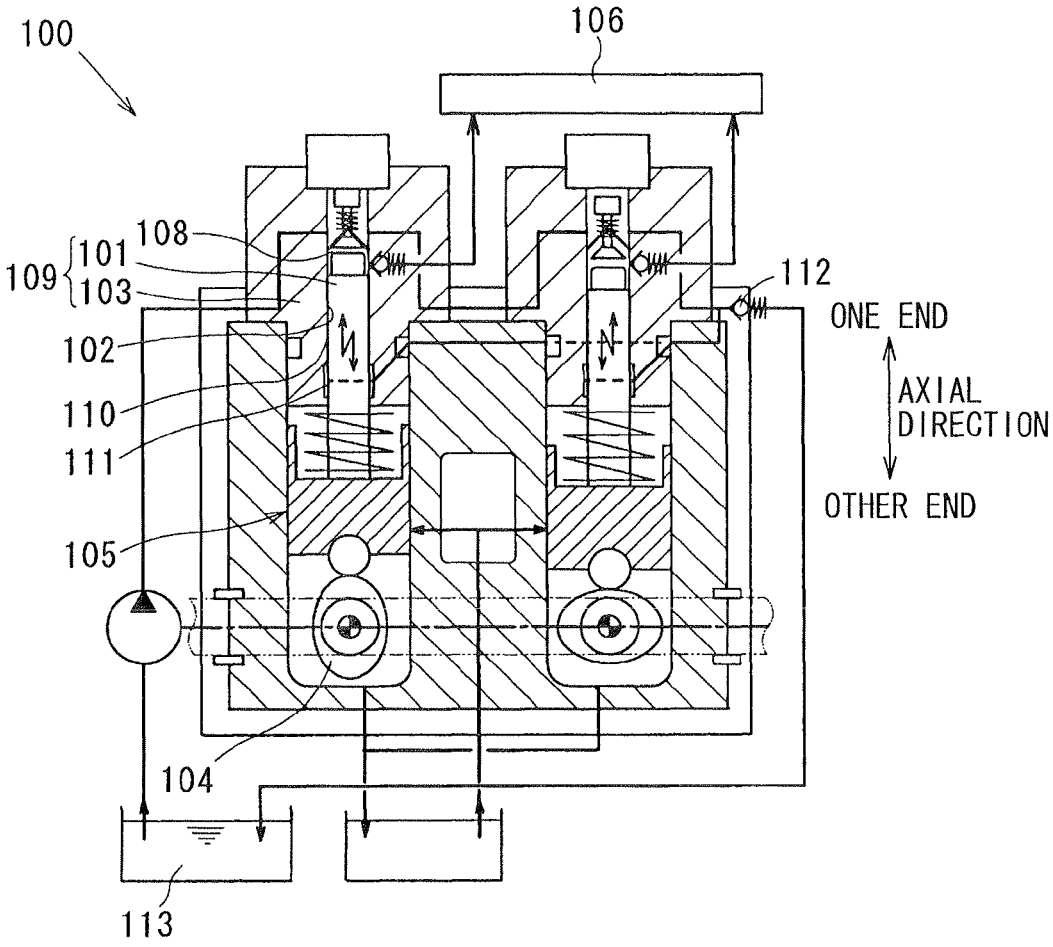
FIG. 4 PRIOR ART
FIG. 4 is a schematic cross sectional view showing a prior art fuel supply pump.

A structure of a fuel supply pump 1 according to an embodiment of the present invention will be described with reference to FIGS. 1 to 3.

The fuel supply pump 1 pressurizes and discharges fuel to be supplied to an internal combustion engine (not shown) of a vehicle (e.g., an automobile). The fuel supply pump 1 is a part of an accumulator type fuel injection system, which injects high pressure fuel received from a common rail (serving as an accumulator) 2 into an internal combustion engine. The fuel supply pump 1 draws fuel from a fuel tank 3 and discharges the same upon pressurizing the same to supply the pressurized fuel to the common rail 2. The fuel injection system includes an undepicted electronic control unit (ECU), which controls an operation of each of corresponding devices, and the operation of the fuel supply pump 1 is also controlled by the ECU.

The fuel supply pump 1 includes a low pressure feed pump 4, first and second high pressure pump systems 5, 6 and a shaft 7. The low pressure feed pump 4 is of a known type and draws fuel from the fuel tank 3. The first and second high pressure pump systems 5, 6 receive the fuel supplied from the low pressure feed pump 4 and discharges the supplied fuel upon pressurizing the same. The shaft 7 is rotated by a rotational force of the internal combustion engine.

The low pressure feed pump 4 is placed at an axial end of the shaft 7 and is rotated by the shaft 7. Two cams 10 are installed to the shaft 7 such that the cams 10 are spaced from each other and are arranged one after another in the axial direction of the shaft 7. Each of these cams 10 is a constituent component of a plunger drive mechanism 11 discussed below. The cams 10 are adapted to convert the rotational motion, which is transmitted from the internal combustion engine, into linear reciprocating motion to drive the first and second high pressure pump systems 5, 6, respectively. Each cam 10 has two cam lobes 12, which are displaced from each other by 180 degrees in the circumferential direction of the shaft 7. Furthermore, the cams 10 are arranged such that a phase of one of the cams 10 is shifted by 90 degrees from a phase of the other one of the cams 10.

Furthermore, the fuel supply pump 1 has a supply passage 13 to supply fuel to the first and second high pressure pump systems 5, 6 and to conduct discharged fuel, which is discharged from the first and second high pressure pump systems 5, 6. More specifically, the supply passage 13 conducts fuel in such a manner that the fuel, which is drawn by the low pressure feed pump 4 from the fuel tank 3 flows through the first and second high pressure pump systems 5, 6 and is thereafter returned to the fuel tank 3 after passing through a check valve 14 provided in the second high pressure pump system 6. Two solenoid valves 15 are placed in two portions, respectively, of the supply passage 13, which pass through the first and second high pressure pump systems 5, 6, respectively. Each solenoid valve 15 opens or closes a connection between the supply passage 13 and a pressurizing chamber 16, in which the fuel is pressurized, of the corresponding one of the first and second high pressure pump systems 5, 6.

Hereinafter, the structure of the fuel supply pump 1 will be described in detail with respect to the first high pressure pump system 5. Here, it should be noted that the second high pressure pump system 6 has the structure similar to that of the first high pressure pump system 5 described below.

The first high pressure pump system 5 includes a high pressure pump 21 and the plunger drive mechanism 11. In the high pressure pump 21, a plunger 20 is supported in a cylinder hole 19 such that the plunger 20 is adapted to axially reciprocate in the cylinder hole 19, and the pressurizing chamber 16 is formed in one end portion of the cylinder hole 19. In the plunger drive mechanism 11, the rotational motion, which is transmitted from the internal combustion engine, is converted into the linear reciprocating motion through the cam 10 and is then conducted to the plunger 20. When the plunger 20 is reciprocated in the axial direction of the plunger 20, the volume of the pressurizing chamber 16 is changed, so that the fuel is drawn into the pressurizing chamber 16 and is discharged from the pressurizing chamber 16 upon pressurization thereof. In the following discussion, the axial direction refers to the axial direction of the plunger 20 unless otherwise defined.

Furthermore, the first high pressure pump system 5 includes the solenoid valve 15, which enables or disables the flow of the fuel into or out of the pressurizing chamber 16 through the supply passage 13. The ECU controls energization of a solenoid coil 22 of the solenoid valve 15 to control the operation of the first high pressure pump system 5.

The high pressure pump 21 includes the plunger 20 and a cylinder body 23. The cylinder body 23 has the cylinder hole 19, and the one end portion of the cylinder hole 19 is fluid-tightly defined by the plunger 20 to form the pressurizing chamber 16. The high pressure pump 21 further includes a spring 25 and a discharge valve 26. The spring 25 urges the plunger 20 toward the other axial end side. The discharge valve 26 opens or closes a connection between the discharge side (common rail 2 side) flow passage of the first high pressure pump system 5 and the pressurizing chamber 16.

The plunger 20 is supported such that the other axial end portion of the plunger 20 projects from the cylinder hole 19, and the one axial end portion of the plunger 20 reciprocates in the cylinder hole 19. The plunger 20 is linearly reciprocated in the axial direction through the operation of the plunger drive mechanism 11 and the urging force of the spring 25. The pressurizing chamber 16 is compressed or expanded in response to the linear reciprocating motion of the plunger 20.

One axial end of the cylinder body 23 is axially recessed to form a recessed portion such that an inner diameter of the recessed portion is reduced in a stepwise manner toward the other axial end of the cylinder body 23. One end of the cylinder hole 19 (i.e., one end of the pressurizing chamber 16) opens in a bottom surface of the recessed portion, which is closest to the other axial end of the cylinder body 23 in the recessed portion. Furthermore, a flow passage forming member 27 is placed at the bottom of the recessed portion to close the opening of the pressurizing chamber 16 located on the one axial side. The flow passage forming member 27 includes a communication passage 29, which communicates between a valve chamber 28 of the solenoid valve 15 and the pressurizing chamber 16. The flow passage forming member 27 serves as a valve seat, against which a valve portion 30 of the solenoid valve 15 is seatable, and also serves as a stopper, which limits movement of the valve portion 30 toward the other axial side.

A valve body 32 of the solenoid valve 15 is received on the one end side of the flow passage forming member 27 in the axial direction in such a manner that the valve body 32 contacts the flow passage forming member 27. An annular fuel flow passage 33 is formed between the cylinder body 23 and the valve body 32. The fuel flow passage 33 forms a portion of the supply passage 13. A female thread is formed in an inner peripheral surface of the cylinder body 23 on the one end side of the fuel flow passage 33 to threadably engage with a male thread of the solenoid valve 15 (more specifically, a male thread of a housing of the solenoid valve 15). Thereby, the solenoid valve 15 is threadably fixed to the cylinder body 23 through the engagement between the female thread of the cylinder body 23 and the male thread of the solenoid valve 15.

Furthermore, a fuel flow passage 34 and a fuel flow passage 35 are formed in the cylinder body 23. The fuel flow passage 34 is communicated with the annular fuel flow passage 33 to form a portion of the supply passage 13. The fuel flow passage 35 communicates between the discharge valve 26 and the pressurizing chamber 16. Furthermore, an upstream side part of the fuel flow passage 34 is communicated with an annular fuel flow passage 37, which is formed by the cylinder body 23 and a pump housing 36 described below. Furthermore, a fuel input pipe 38 is installed to the pump housing 36 to guide the fuel, which is drawn from the fuel tank 3, to the fuel flow passage 37. The fuel flow passage 37 and the fuel input pipe 38 form a portion of the supply passage 13.

One end of the spring 25 is supported by an upper seat 43 to limit expansion of the spring 25 toward the one axial side, and the other end of the spring 25 is supported by a tappet body 42 through a lower seat 41. The spring 25 urges the plunger 20 toward the other axial side such that the other end (hereinafter referred to as a plunger head 44) of the plunger head 44 is always engaged with the tappet body 42 through the lower seat 41. At the same time, the spring 25 urges the entire plunger drive mechanism 11 toward the other axial side by urging the tappet body 42 toward the other axial side through the lower seat 41.

The discharge valve 26 is received in a valve holder 46, which is securely and threadably engaged with the cylinder body 23. A fuel flow passage 47 is formed in the valve holder 46 and is communicated with a downstream end of the fuel flow passage 35. The discharge valve 26 is received in the fuel flow passage 47. The discharge valve 26 includes a valve element 48 and a spring 49. The valve element 48 is adapted to reciprocate to open or close the fuel flow passage 47. The spring 49 urges the valve element 48 in a closing direction against a valve seat to close the fuel flow passage 47 with the valve element 48. When the fuel pressure in the pressurizing chamber 16 becomes larger than a predetermined valve opening pressure, the valve element 48 is lifted away from the valve seat, so that the discharge valve 26 is opened.

The plunger drive mechanism 11 includes the tappet body 42, a roller 52 and a shoe 53. The tappet body 42 is received in and is supported by a cylindrical support hole 51 such that the tappet body 42 axially reciprocates in the cylindrical support hole 51. The roller 52 is received in the tappet body 42 and contacts an outer peripheral surface of the cam 10. When the cam 10 is rotated, the roller 52 is reciprocated in the axial direction while being rotated by the cam 10. The shoe 53 is fixed in the tappet body 42 and is axially reciprocated together with the tappet body 42. The shoe 53 supports the roller 52 from the radially outer side of the roller 52.

A partitioning portion 54 is formed in a radially inner part of the tappet body 42. The partitioning portion 54 has an axial wall thickness, and the plunger head 44 contacts the partitioning portion 54. A radially inner area of the tappet body 42 is partitioned between one axial end portion and the other axial end portion by the partitioning portion 54. A contact portion of the plunger head 44 and a support seat for supporting the spring 25 through the lower seat 41 are provided in the one end surface of the partitioning portion 54. Furthermore, the roller 52 and the shoe 53 are received on the other end side of the partitioning portion 54. The roller 52 is received such that a rotational axis of the roller 52 is generally perpendicular to the axial direction of the plunger 20.

Furthermore, the support hole 51 is formed in the pump housing 36, to which the high pressure pump 21 is installed. The high pressure pump 21 (more specifically, the cylinder body 23 of the high pressure pump 21) is installed to the pump housing 36 such that the high pressure pump 21 is coaxial with the support hole 51, and thereby the high pressure pump 21 closes the one end of the support hole 51. The other end of the support hole 51 opens to the cam chamber 55, which receives the cam 10. At the other end of the support hole 51, an outer peripheral surface of the roller 52 and an outer peripheral edge of the cam 10 contact with each other such that the roller 52 is rotated by the cam 10.

A rotation limiting portion is formed in the plunger drive mechanism 11 to limit rotation of the plunger drive mechanism 11 about an axis of the plunger drive mechanism 11, which is parallel to the axial direction of the plunger 20. Specifically, in the plunger drive mechanism 11, a positioning member (not shown), which circumferentially position the plunger drive mechanism 11, is securely press fitted to an outer peripheral surface of the tappet body 42, and the positioning member is slidably fitted into a slide groove (not shown), which is formed in a wall surface of the support hole 51.

The friction (hereinafter also referred to as component-to-component friction) between the components of the plunger drive mechanism 11 is alleviated by lubricating oil, which has a viscosity higher than that of the fuel.

The lubricating oil is supplied from a lubricating oil suction inlet into a slide clearance between the hole wall (inner peripheral wall) of the support hole 51 and the outer peripheral surface of the tappet body 42, so that the lubricating oil lubricates the connection (contact area) between the hole wall of the support hole 51 and the tappet body 42, the connection (contact area) between the roller 52 and the shoe 53 and the connection (contact area) between the roller 52 and the cam 10 and is thereafter supplied to and is received in the cam chamber 55. The lubricating oil, which is received in the cam chamber 55, is drawn out of the fuel supply pump 1 through a lubricating oil suction outlet.

The solenoid valve 15 includes the solenoid coil 22, a stator 57, an armature 58, the spring 59, a valve element 62 and the valve body 32. Energization of the solenoid coil 22 is controlled by the ECU. When the solenoid coil 22 is energized, the solenoid coil 22 generates a magnetic flux, which is conducted through the stator 57. Thereafter, the magnetic flux is passed to the armature 58. The armature 58 is magnetically attracted to the stator 57 toward the one axial side. The spring 59 urges the armature 58 toward the other axial side. The valve element 62 is axially moved together with the armature 58, so that the valve element 62 opens or closes the connection between the upstream side fuel flow passages 60, 61, which form a part of the supply passage 13, and the pressurizing chamber 16. The valve body 32 axially slidably supports a shaft 63 of the valve element 62 and forms the valve chamber 28, which receives a valve portion 30 of the valve element 62.

A slide hole 64, which slidably receives the shaft 63, is formed in the valve body 32 such that the slide hole 64 axially extends through the valve body 32. The valve chamber 28 is formed at the other end of the slide hole 64.

The armature 58 is fixed to the one axial end portion of the shaft 63, which projects from the slide hole 64. The other axial end portion of the shaft 63 has a reduced diameter part that is configured such that the reduced diameter part has a reduced outer diameter, which is smaller than that of an axial center portion of the shaft 63 axially located between the one end portion and the other end portion of the shaft 63. Thereby, the annular fuel flow passage 60 is formed between the shaft 63 and the wall surface of the slide hole 64. A fuel flow passage 61 is formed in the valve body 32 such that the fuel flow passage 61 communicates between the fuel flow passage 33 and the fuel flow passage 60.

A seat surface 65 is formed in a tapered wall surface of the valve body 32 at one end side part of the valve chamber 28. The valve portion 30 of the valve element 62 seats against the seat surface 65 when the armature 58 and the valve element 62 are moved toward the one axial side upon the energization of the solenoid coil 22. When the valve portion 30 of the valve element 62 seats against the seat surface 65, the connection between the valve chamber 28 and the fuel flow passage 60 is closed. Furthermore, when the armature 58 and the valve element 62 are urged toward the other axial side by the spring 59 upon deenergization of the solenoid coil 22, the valve portion 30 is lifted away from the seat surface 65. Thereby, the connection between the valve chamber 28 and the fuel flow passage 60 is opened. At this time, the valve portion 30 of the valve element 62 contacts the flow passage forming member 27, so that the movement of the valve element 62 toward the other axial side is limited.

With the above described construction, in the fuel supply pump 1, the solenoid valve 15 is operated to close the valve element 62 when the plunger 20 is moved toward the one axial side to compress the pressurizing chamber 16. In this way, the fuel supply pump 1 serves as a discharge quantity metering pump, which meters a discharge quantity of fuel discharged from the pressurizing chamber 16.

Specifically, at the time of moving the plunger 20 toward the one axial side to compress the pressurizing chamber 16, when the solenoid coil 22 is energized in response to the corresponding command from the ECU, the valve portion 30 of the valve element 62 is seated against the seat surface 65 to close the connection between the valve chamber 28 and the fuel flow passage 60 and the connection between the pressurizing chamber 16 and the upstream side fuel flow passages 60, 61. In this way, the fuel pressure of the pressurizing chamber 16 is increased and becomes larger than the valve opening pressure of the discharge valve 26. Thus, the discharge valve 26 is opened, and thereby the fuel supply from the fuel supply pump 1 to the common rail 2 is started.

When the energization of the solenoid coil 22 is stopped in response to the corresponding command from the ECU, the valve portion 30 of the valve element 62 is lifted away from the seat surface 65 to open the connection between the valve chamber 28 and the fuel flow passage 60 and the connection between the pressurizing chamber 16 and the upstream side fuel flow passages 60, 61. In this way, the fuel pressure of the pressurizing chamber 16 is decreased and becomes smaller than the valve opening pressure of the discharge valve 26. Thus, the discharge valve 26 is closed, and thereby the fuel supply from the fuel supply pump 1 to the common rail 2 is terminated.

Now, the characteristics of the fuel supply pump of the present embodiment will be described with reference to the accompanying drawings.

The fuel of the pressurizing chamber 16 leaks from the pressurizing chamber 16 toward the other axial end side through the slide clearance 67 between the plunger 20 and the cylinder body 23. In the slide clearance 67, a leak recovery groove 68 is formed between the slidable surface (the hole wall surface, which forms the cylinder hole 19) of the cylinder body 23 and the slidable surface of the plunger 20 (the outer peripheral surface of the plunger 20) by radially outwardly recessing a portion of the slidable surface (the hole wall surface, which forms the cylinder hole 19) of the cylinder body 23. The leak recovery groove 68 is adapted to recover the leaked fuel, which is leaked from the pressurizing chamber 16.

The leak recovery groove 68 is configured into an annular form, which circumferentially surround the plunger 20 on the radially outer side of the plunger 20. In the following discussion, a portion of the slide clearance 67, which is located on the one axial side of the leak recovery groove 68, will be also referred to as a slide clearance 67A. Also, another portion of the slide clearance 67, which is located on the other axial end side of the leak recovery groove 68, will be also referred to as a slide clearance 67B.

A leak recovery groove direct communication passage 69 is connected to the leak recovery groove 68. The leak recovery groove direct communication passage 69 is branched from the supply passage 13 to guide the fuel to the leak recovery groove 68 without passing through the pressurizing chamber 16. The leak recovery groove direct communication passage 69 connects between the fuel flow passage 37 and the leak recovery groove 68 while bypassing the pressurizing chamber 16. Thereby, the high temperature fuel, which is leaked from the pressurizing chamber 16 through the slide clearance 67A, and the fuel, which bypasses the pressurizing chamber 16, are both supplied to the leak recovery groove 68.

Then, the fuel of the leak recovery groove 68 is returned to the fuel tank 3 through a return flow passage 70. The return flow passage 70 extends outward from the fuel supply pump 1 and is connected to the fuel tank 3. An outlet 71 of the return flow passage 70 at the fuel supply pump 1 is located on the upper side of the leak recovery groove 68 in the vertical direction (the direction of gravity).

A check valve, which limits a backflow of fuel from the fuel tank 3 to the leak recovery groove 68, is not provided in the return flow passage 70. In other words, the return flow passage 70 forms an uninterrupted continuous flow passage from the leak recovery groove 68 to the fuel tank 3.

Furthermore, a choked portion (choked flow section) 72, which has a passage cross-sectional area smaller than its adjacent upstream and downstream side flow sections, is formed in the leak recovery groove direct communication passage 69. An angle between the flow passage axis of the leak recovery groove direct communication passage 69 and the axis of the plunger 20 is set to be larger than zero (0) degrees and is equal to or smaller than 45 degrees.

Now, advantages of the present embodiment will be described.

In the fuel supply pump 1 of the present embodiment, the leak recovery groove direct communication passage 69 is connected to the leak recovery groove 68. The leak recovery groove direct communication passage 69 guides the fuel from the supply passage 13, which supplies the fuel to the pressurizing chamber 16, to the leak recovery groove 68 without passing through the pressurizing chamber 16.

Thereby, the low temperature fuel, which has not been pressurized in the pressurizing chamber 16, is guided to the leak recovery groove 68. Thus, the high pressure pump 21 can be cooled with the low temperature fuel, so that it is possible to limit the increasing of the temperature of the high pressure pump 21 to the high temperature even when the discharge pressure of the fuel is further increased at the fuel supply pump 1.

Furthermore, the choked portion 72 is formed in the leak recovery groove direct communication passage 69.

Thereby, in the flow passage of the cooling fuel, which extends from the leak recovery groove direct communication passage 69, the leak recovery groove 68 and the return flow passage 70 in this order, the pressure of the flow passage section, which is located on the downstream side of the choked portion 72, can be reduced, and thereby the pressure of the fuel in the leak recovery groove 68 can be reduced. Thus, it is possible to limit the leakage of the fuel from the leak recovery groove 68 to the other axial end side through the slide clearance 67B, and thereby it is possible to reduce or minimize the possibility of occurrence of the lubrication failure, which would be otherwise caused by the dilution of the lubricating oil by the leaked fuel.

Furthermore, the check valve, which limits the backflow of fuel from the fuel tank 3 to the leak recovery groove 68, is not provided in the return flow passage 70.

Thereby, the passage of the cooling fuel can be opened to the atmosphere. Thus, it is possible to further reduce the pressure of the fuel in the leak recovery groove 68, and thereby it is possible to further limit the leakage of fuel from the leak recovery groove 68 to the other axial end side through the slide clearance 67B. In this way, it is possible to reduce or minimize the possibility of occurrence of the lubrication failure.

Furthermore, the outlet 71 of the return flow passage 70 at the fuel supply pump 1 is located on the upper side of the leak recovery groove 68 in the vertical direction (the direction of gravity).

Therefore, it is possible to limit the occurrence of intrusion of the air bubbles into the return flow passage 70, which would be caused by the absence of the check valve in the return flow passage 70. Specifically, in the case where the check valve is not provided in the return flow passage 70, since the flow passage of the cooling fuel is opened to the atmosphere, the air bubbles may possibly enter the fuel supply pump 1 through the passage of the cooling fuel. In view of this point, the outlet 71 of the return flow passage 70 at the fuel supply pump 1 is placed on the upper side of the leak recovery groove 68 in the vertical direction (the direction of gravity) to limit the intrusion of the air bubbles into the return flow passage 70.

Furthermore, the flow passage axis of the leak recovery groove direct communication passage 69 and the axis of the plunger 20 is set to be larger than zero (0) degrees and is equal to or smaller than 45 degrees.

In this way, the leak recovery groove direct communication passage 69 can be extended along the slide clearance 67A. Thereby, it is possible to promote the heat conduction between the low temperature fuel, which flows in the leak recovery groove direct communication passage 69, and the high temperature fuel, which flows through the slide clearance 67A.

The fuel supply pump of the present invention is not limited to the above embodiment, and the above embodiment may be modified in various ways within the scope and sprit of the present invention.

For example, the low pressure feed pump 4 of the above embodiment is provided to the axial end of the shaft 7 and is rotated by the shaft 7. Alternatively, an electric pump, which is provided separately from the fuel supply pump 1, may be used as the low pressure feed pump 4. In this way, the low pressure feed pump 4 can be freely controlled by the ECU regardless of the rotation of the internal combustion engine.

Furthermore, the two cams 10 are provided to the shaft 7 of the above embodiment, such that each of the cams 10 has the two cam lobes 12, which are arranged one after another at 180 degree intervals in the circumferential direction of the shaft 7, and the phase difference between these two cams 10 is set to be 90 degrees. However, the arrangement of the cam(s) 10 and the cam lobes 12 is not limited to the above one. For example, the two cams 10 may be provided to the shaft 7 such that each of the cams 10 includes three cam lobes 12, which are circumferentially arranged one after another at 120 degree intervals, and a phase difference between the two cams 10 is set to be 60 degrees.

Furthermore, in the plunger drive mechanism 11 of the above embodiment, the friction between the components is alleviated by the lubricating oil, which has the viscosity higher than that of the fuel. Alternatively, the friction between the components of the plunger drive mechanism 11 may be alleviated by using the fuel as the lubricant.

Furthermore, the fuel supply pump 1 of the above embodiment is the discharge quantity metering pump. Alternatively, for example, an intake metering valve of a solenoid type, which meters the intake quantity of fuel supplied to the pressurizing chamber 16, may be installed to the fuel supply pump 1 to make the fuel supply pump 1 as an intake quantity metering pump.

Additional advantages and modifications will readily occur to those skilled in the art. The invention in its broader terms is therefore not limited to the specific details, representative apparatus, and illustrative examples shown and described.

What is claimed is:

1. A fuel supply pump comprising:

a plunger that is adapted to reciprocate in an axial direction thereof; and a cylinder body that includes a cylinder hole, in which the plunger is axially slidably received, wherein:

one axial end portion of the cylinder hole is fluid-tightly closed by the plunger to form a pressurizing chamber therein;

the plunger is adapted to reciprocate and slide in the axial direction in the cylinder hole to change a volume of the pressurizing chamber and thereby to draw fuel into the pressurizing chamber and then discharge the fuel from the pressurizing chamber upon pressurization of the fuel in the pressurizing chamber;

a slide clearance is formed between the plunger and the cylinder body and enables leakage of fuel from the pressurizing chamber, which is located on one axial side of the slide clearance, toward the other axial side of the slide clearance through the slide clearance;

a leak recovery groove is formed in the slide clearance between a slidable surface of the cylinder body and a slidable surface of the plunger by radially outwardly recessing a portion of the slidable surface of the cylinder body to recover leaked fuel, which is leaked from the pressurizing chamber;

a leak recovery groove direct communication passage is branched from a supply passage, which supplies fuel to the pressurizing chamber, and is connected to the leak recovery groove without passing through the pressurizing chamber to supply the fuel from the supply passage to the leak recovery groove, a choked portion is formed in the leak recovery groove direct communication passage; and a return flow passage is connected to the leak recovery groove to return the leaked fuel, which is leaked from the pressurizing chamber and is received in the leak recovery groove, and the fuel, which is conducted from the leak recovery groove direct communication passage, to a fuel tank.

2. The fuel supply pump according to claim 1, wherein a choked portion is formed in the leak recovery groove direct communication passage.

3. The fuel supply pump according to claim 1, wherein:

the return flow passage extends outwardly from the fuel supply pump and is connected to the fuel tank; and an outlet of the return flow passage at the fuel supply pump is located on an upper side of the leak recovery groove in a vertical direction.

4. The fuel supply pump according to claim 1, wherein an angle between a flow passage axis of the leak recovery groove direct communication passage and an axis of the plunger is set to be larger than 0 degrees and is equal to or smaller than 45 degrees.

5. The fuel supply pump according to claim 1, further comprising a plunger drive mechanism, which converts rotational motion transmitted from an internal combustion engine into linear reciprocating motion through a cam and conducts the linear reciprocating motion to the plunger to drive the plunger, wherein component-to-component friction of the plunger drive mechanism is alleviated by lubricating oil that has a viscosity, which is higher than that of the fuel.

* * * * *